US005699816A

United States Patent [19]

Banes et al.

[11] Patent Number: 5,699,816

[45] Date of Patent: Dec. 23, 1997

[54] FINGERNAIL PROTECTOR

[75] Inventors: Cheryl Ann Banes, Chicago; Joseph Born, Lincolnwood, both of Ill.

[73] Assignee: Cherylann Company, Skokie, Ill.

[21] Appl. No.: 584,250

[22] Filed: Jan. 11, 1996

[51] Int. Cl.[6] ..... A45D 29/00

[52] U.S. Cl. ..... 132/285; 132/73; 132/73.5; 132/319

[58] Field of Search ..... 132/285, 73, 73.5, 132/75, 319; 2/21, 163, 167; D28/56, 57, 58, 59, 60, 61, 62

[56] References Cited

U.S. PATENT DOCUMENTS

| | | | |
|---|---|---|---|
| D. 136,030 | 7/1943 | Belmonte et al. . | |
| D. 147,797 | 11/1947 | Kayer . | |
| D. 259,444 | 6/1981 | Wood . | |
| D. 278,368 | 4/1985 | Valentiner . | |
| D. 329,923 | 9/1992 | Thaxton . | |
| 2,179,046 | 11/1939 | Lewis . | |
| 2,251,551 | 8/1941 | O'Reilly . | |
| 2,297,807 | 10/1942 | Sommers . | |
| 2,323,854 | 7/1943 | Silverman . | |
| 2,458,709 | 1/1949 | Kayer . | |
| 2,487,101 | 11/1949 | Colby et al. . | |
| 2,514,975 | 7/1950 | Smidl . | |
| 2,546,619 | 3/1951 | Turner . | |
| 2,557,759 | 6/1951 | Pfister . | |
| 2,580,893 | 1/1952 | Dee . | |
| 4,089,066 | 5/1978 | Dethman . | |
| 4,665,934 | 5/1987 | Jefferson . | |
| 4,966,174 | 10/1990 | Stanczak | 132/73 |
| 4,972,857 | 11/1990 | Stewart et al. . | |
| 4,984,592 | 1/1991 | Hellein . | |
| 5,085,234 | 2/1992 | Silverman . | |
| 5,186,189 | 2/1993 | Harris | 132/285 |
| 5,282,276 | 2/1994 | Preziose | 2/21 |
| 5,540,243 | 7/1996 | Simonton | 132/73 |

*Primary Examiner*—Gene Mancene
*Assistant Examiner*—Pedro Philogene
*Attorney, Agent, or Firm*—Lloyd L. Zickert; Adam H. Masai

[57] ABSTRACT

An adjustable fingernail protector for protecting the paint or polish on a fingernail after a manicure, which is attached to the finger primarily ahead of the first knuckle and behind the fingernail to avoid significantly impairing the motion of the hands. The fingernail protector includes a fingernail protective shield having a supporting base and a hood, and a securing band adapted to releasably secure the supporting base to the finger to maintain the protective shield on the finger.

33 Claims, 2 Drawing Sheets

FINGERNAIL PROTECTOR

This invention relates in general to a fingernail protector, and more particularly to an unobtrusive adjustable device for protecting the polish or paint on a fingernail during drying after a manicure, which is primarily adapted to be securely attached to the finger behind the nail and ahead of the first knuckle without significantly impairing the motion of the fingers and hands.

BACKGROUND OF THE INVENTION

Heretofore, it has been well known to attach covering or protective devices to the fingers after a manicure to protect the nail polish or paint drying on the fingernails. For example, such devices are disclosed in U.S. Pat. Nos. 2,323,854, 2,458,709, 2,487,101, 4,089,066, 4,665,934, 4,984,592, 5,085,234, 5,282,276, Des. 136,030, and Des. 147,797. However, such devices can be obtrusive and can impair the movement and use of the hands and fingers, in part because they are bulky and are attached to the fingers substantially over and behind the first knuckle. These devices are also not readily adaptable or not easily adjustable for different size fingers. This results in the need to have a multiplicity of different size devices to accommodate the different size hands and fingers. Further, some of these devices are complex, which increases the overall production costs. Because some of these devices are bulky, they are visually unappealing. Finally, the attachment means used in some of these devices make it difficult to maintain the level of rigidity necessary to protect the nails.

SUMMARY OF THE INVENTION

The present invention overcomes the above problems in providing an unobtrusive adjustable fingernail protector which is attached to the finger primarily behind the nail and ahead of the first knuckle and which provides substantial protection for the fingernail polish after a manicure while the polish is drying. The present invention could also be used to generally protect the fingernail. The fingernail protector of the present invention is a two-piece assembly including a substantially rigid fingernail protective shield and a securing band for adjustably attaching and securing the protective shield to the finger.

More particularly, in one embodiment the substantially rigid fingernail protective shield has a supporting base and a hood extending from the supporting base. The supporting base engages the top of the finger behind the nail and ahead of the first knuckle. The hood has top, forward, back, and side walls which define a fingernail cavity or chamber open at the bottom end for receiving the fingernail. The hood is suitably sized to shield and cover the nail without touching the top of the nail. The securing band has first and second sections pivotally connected by an integral hinge. To secure the protective shield on the finger, the first section of the band is positioned over and snapped on the supporting base, and the second section is rotated around the finger and snapped or locked onto the first section to rigidly secure the protector on the finger to prevent the protector from contacting the nail during normal use. The first and second sections of the securing band have mating or coacting ratchet teeth which facilitate adjustment of the fingernail protector on different size fingers as well as the desired tightness around the finger. The fingernail protector, and particularly the rigid hood, prevent objects from contacting the top surface of the nail to protect nail polish against damage while drying and curing. After the nails are dry, the securing band is unsnapped and the protective shield is removed.

Another embodiment of the fingernail protector of the present invention is made as a single-piece assembly including a substantially rigid fingernail protective shield and a rotatable securing band for adjustably securing the protective shield to the finger. Specifically, the protective shield has a semi-cylindrical supporting base and a hood extending from the base. The base is adapted to engage the bottom of the finger ahead of and below the first knuckle and behind the fingernail. The rigid hood has top, forward, and side walls which define a fingernail cavity or chamber for receiving the fingernail. The hood is suitably sized to shield and cover the nail without touching the top of the nail or any polish applied thereto. The semi-circular securing band is pivotally connected to the supporting base by an integral hinge and is adapted to substantially mate with the top of the finger ahead of the first knuckle and behind the nail. The securing band includes a plurality of ratchet teeth adapted to mate or coact with a plurality of ratchet teeth on the supporting base for facilitating the adjustable locking of the fingernail protector on the finger.

It is therefore an object of the present invention to provide a new and improved unobtrusive fingernail protector for protecting a fingernail with wet paint or polish from a manicure until the paint or polish is dry or cured.

Another object of the present invention is to provide a new and improved low-cost one-piece or two-piece fingernail protector that is adjustable to fit on fingers of varying size and shape and to accommodate fingernails of various lengths.

A further object of the present invention is to provide a new and improved fingernail protector for protecting wet polish on a fingernail after a manicure against damage that is placed on the finger between the knuckle and the nail to minimize the impairment of the use of the fingers and hands during drying of the polish.

A still further object of the present invention is to provide an improved fingernail protector of two-piece construction where one piece may be thermoformed and the other piece is extruded to enable the most economical manufacture of the protector.

Other objects, features and advantages of the invention will be apparent from the following detailed disclosure, taken in conjunction with the accompanying sheets of drawings, wherein like reference numerals refer to like parts.

DESCRIPTION OF THE INVENTION

Figure 1:
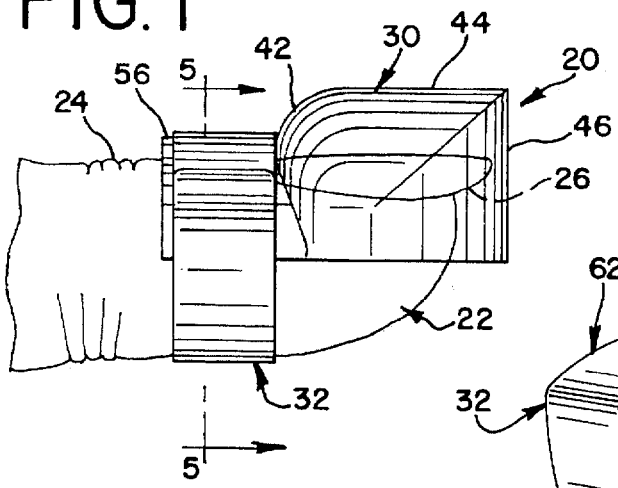
FIG. 1 is a side elevational view of the fingernail protector of the present invention mounted on a finger ahead of the first knuckle.

Referring now to the drawings, and particularly to FIGS. 1 to 5, the fingernail protector of the present invention, generally indicated by numeral 20, is adapted to be attached to a finger 22 between the first knuckle 24 and the fingernail 26 to shield and protect the fingernail. The fingernail protector 20 of the present invention is preferably of a two-piece construction consisting of a substantially rigid fingernail protective shield 30 and an adjustable securing band 32. The protective shield 30 covers and shields the fingernail and prevents anything from contacting the surface or end of the nail. For example, after a manicure, which includes the application of a coating of paint or polish on a fingernail, mounting the protective shield on the finger would protect the coating while drying and curing against damage. The securing band 32 secures and maintains the protective shield 30 on the finger 22. After the paint or polish is dry, the securing band and the protective shield are removed, and may be discarded, recycled, or cleaned and saved for further use. It should be appreciated that the fingernail protector of the present invention could also be used to generally protect the fingernail in other situations such as against chipping of a coating of polish.

The protective shield 30 is preferably thermoformed or vacuum formed from a transparent or translucent polystyrene material since such a material is relatively inexpensive and provides the benefit of allowing the nail to be visible. The securing band 32 is preferably extruded from a substantially rigid polyvinylchloride (PVC) material with the integral hinge being co-extruded from a flexible material such as a flexible PVC. Alternatively, the entire fingernail protector could be injection molded or otherwise suitably formed from a suitable plastic.

Figure 5:
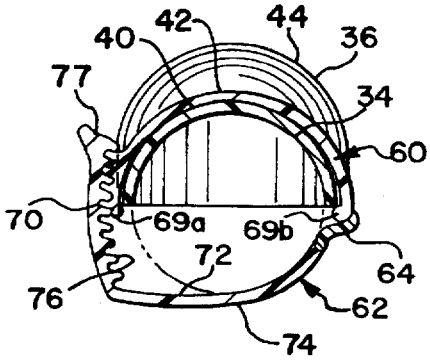
FIG. 5 is a cross-sectional view taken substantially along line 5—5 of FIG. 1.

The protective shield 30 has a substantially rigid semi-cylindrical supporting base 34 for engaging the finger and a substantially rigid hood 36 extending from the base 34 for protecting the nail. The semi-cylindrical base 34 has an inner surface 38 and an outer surface 40. The inner surface 38 is adapted to engage the top and sides of the finger 22 ahead of the first knuckle 24 and behind the fingernail 26. The outer surface 40 is adapted to receive the securing band 32, as shown in FIGS. 1 and 5 and as discussed below.

The hood 36 includes a back wall 42, a top wall 44, a forward wall 46, and opposite side walls 48 and 50, respectively. The back wall 42 is integrally formed with and extends upwardly from the front edge of the base 34. The top wall 44 is integrally formed with and extends outwardly from the top front edge of the back wall 42. The forward wall 46 is integrally formed with and extends downwardly from the front edge of the top wall 44. The opposite side walls 48 and 50 are integrally formed with the side front edges of the back wall 42, the side edges of the top wall 44, and back edges of the forward wall 46. The rigid back, top, forward, and side walls of the hood 36 define a fingernail cavity or chamber 52. The fingernail cavity 52 is open at its bottom and is suitably sized and adapted to receive and generally enclose a fingernail, as illustrated in FIG. 1. When mounted on the finger, the rigid back, top, forward, and side walls prevent objects from contacting the nail.

The protective shield 30 further includes a projecting lug 56 integrally formed with and extending upwardly from the upper surface 40 at the rear end of the base 34 opposite the back wall 42. The projecting lug 56 is suitably sized to prevent the securing band from sliding backwards (i.e., toward the knuckle 24) and off the supporting base 34.

The securing band 32 includes first and second sections 60 and 62, respectively, wherein the second section 62 is pivotally connected to the first section 60 by an integral hinge 64. The integral hinge 64 is preferably co-extruded with the first and second sections from a more flexible material than that of the sections, thereby providing a flexible pivotal connection between the sections.

The first section 60 is generally semi-circular in shape and has inner and outer surfaces 66 and 68, respectively. The inner surface 66 is adapted to substantially mate with the outer surface 40 of the supporting base 34 between the back wall 42 and the projecting lug 56, as shown in FIG. 1. The first section 60 also includes latching tabs or projections 69*a* and 69*b* for engaging the opposite edges of the supporting base 34 when the first section of the securing band is snapped onto the supporting base of the shield or cover to facilitate the handling of the protector. A plurality of transversely extending ratchet teeth 70 are integrally formed on the outer surface 68 of the first section 60 at the end of the first section opposite the integral hinge 64. While it is preferable that hinge 64 be of a more flexible material than sections 60 and 62, it should be appreciated the entire securing band may be made of the same plastic material where hinge 64 could be a live hinge.

Figure 2:
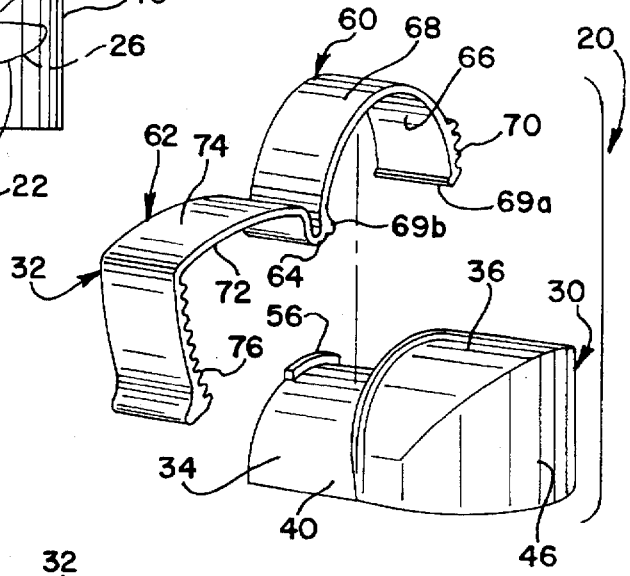
FIG. 2 is an exploded front perspective view of the fingernail protective shield and the securing band shown in FIG. 1.
Figure 3:
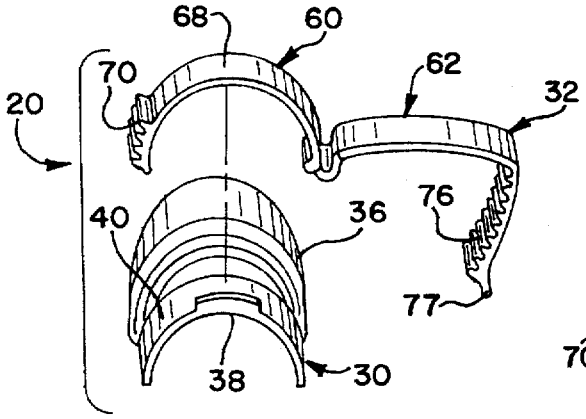
FIG. 3 is an exploded rear perspective view the protective shield and the securing band of FIG. 1.

The second section 62 of the securing band 32 is substantially L-shaped and has inner and outer surfaces 72 and 74, respectively. The inner surface 72 is adapted to substantially engage the bottom and/or sides of the finger 22 ahead of the first knuckle 24, as shown in FIGS. 1 and 5. A series or plurality of transversely extending ratchet teeth 76 are integrally formed on the inner surface 72 of the second section 62 at the end of the second section opposite the integral hinge 64. The ratchet teeth 76 on the inner surface 72 of the second section 62 are adapted to mate with the ratchet teeth 70 on the outer surface 68 of the first section 60 when the second section is rotated around the finger from the open position, as shown in FIGS. 2 and 3, to the closed position, as shown in FIGS. 1 and 5, to lock the protective shield 30 on the finger 22. The plurality of ratchet teeth 70 and 76 facilitate the adjustability of the fingernail protector of the present invention to fit fingers of different sizes. The securing band 32 locks the supporting base 34 on the finger between the nail and the first knuckle to maintain the protective shield on the finger and particularly the hood over the nail. The second section 62 also includes a release tab 77 positioned on the outer surface 74 at the end opposite the integral hinge 64. After the nails are dry, the securing band is unlocked or unsnapped by applying force to the release tab and the protective shield is removed from the finger.

It should be appreciated that while the fingernail protector of the present invention is adjustable, it is contemplated that there will still be a need for a limited number of sizes, such as small, medium, and large. However, the number of sizes need not be as numerous as required by the prior art devices.

Figure 6:
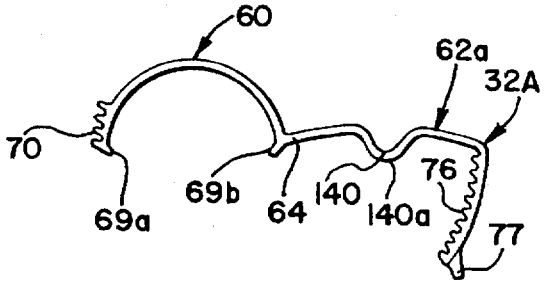
FIG. 6 is a side elevational view of the modified securing band.
Figure 4:
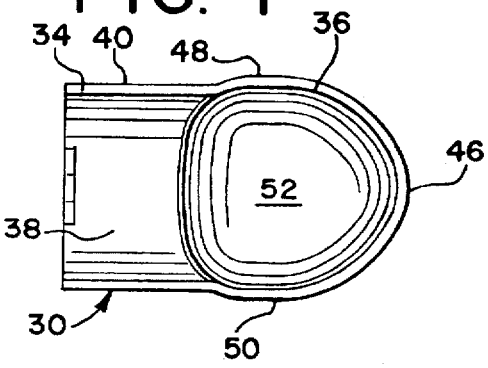
FIG. 4 is an bottom plan view of the protective shield.

A preferred securing band for securing the shield 30 to a finger is shown in FIG. 6 and designated as 32A. This band differs from the securing band 32 only in the form of the rotatable or movable finger-engaging section 62*a*, whereby the section includes a centrally disposed generally U-shaped finger contact member 140. The finger contact member defines a smooth rounded surface 140*a* that limits the contact between section 62*a* and the finger to the area of the contact member 140 so as to reduce the possibility of inhibiting the circulation of the finger during the time that the fingernail protector is worn by the user. This contact member generally extends parallel to the long axis of the finger. The contact member could take other forms which would serve the same purpose of limiting the chance of interfering with finger circulation. Otherwise, the securing band functions identically to the securing band 32 previously described.

Referring now to FIGS. 7 to 11, a further embodiment of the fingernail protector of the present invention is shown and generally indicated by numeral 100. The fingernail protector 100 is a single or one-piece unit including a substantially rigid fingernail protective shield102 and a securing band 104 hingedly connected to the protective shield by an integral or live hinge 123. The securing band 104 is adapted to engage a finger between the first knuckle 24 and the fingernail 26 and adjustably secure and maintain the protective shield 102 on the finger 22 to protect the fingernail. The fingernail protector 100 is preferably suitably molded from a polyvinyl chloride, polyethylene, or polystyrene material. More specifically, the fingernail protector 100 could be injection molded or otherwise suitably formed from any suitable plastic.

The protective shield 102 includes a semi-cylindrical supporting base 106 and a hood 108 extending from the base 106. The semi-cylindrical base 106 has outer and inner surfaces 110 and 112. The inner surface 112 is adapted to engage the bottom and sides of the finger 22 under the first knuckle 24 and behind the fingernail 26. A plurality of transversely extending ratchet teeth 130 are integrally formed on the outer surface 110 of the supporting base.

Figure 7:
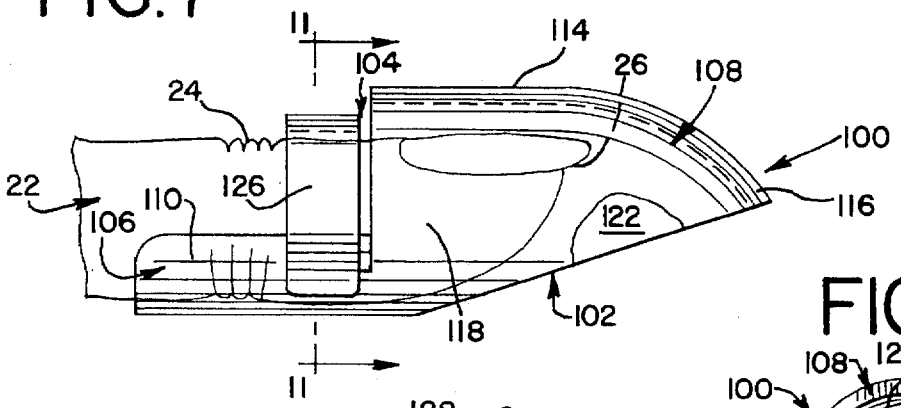
FIG. 7 is a side elevational view of a modification of the present invention illustrated in mounted position on a finger.

The hood 108 includes a top wall 114, a forward wall 116, and opposite side walls 118 and 120, respectively. The side walls 118 and 120 are integrally formed with and extend upwardly from the top and front edges of the supporting base 106. The top wall 114 is integrally formed with and extends outwardly from the top edges of the side walls 118 and 120. The forward wall 116 is integrally formed with and extends downwardly from the front edge of the top and side walls. The rigid top, forward, and side walls of the hood 108 define a fingernail cavity or chamber 122. The fingernail cavity 122 which is open at its bottom is suitably sized and adapted to receive the fingernail, as illustrated in FIG. 7. The protective shield is placed on the finger by inserting the finger through the circular opening defined by the supporting base and the hood. When mounted on the finger, the rigid top, forward, and side walls prevent objects from contacting the nail.

Figure 8:
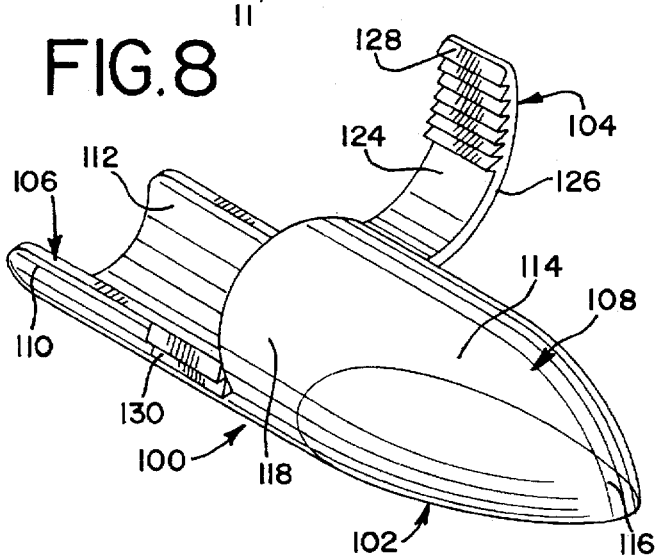
FIG. 8 is a frontal perspective view of fingernail protector of FIG. 7 illustrating the protective shield and the securing band in open position.
Figure 10:
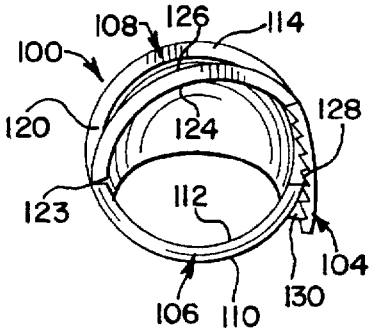
FIG. 10 is an end view the fingernail protector of FIG. 7 looking at the end opposite the shield end.
Figure 11:
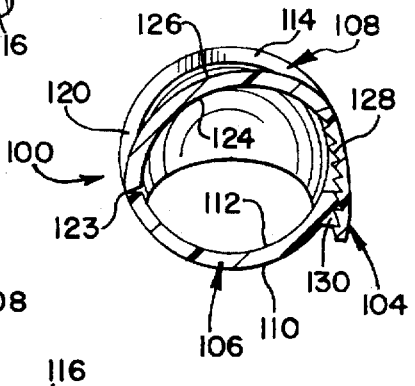
FIG. 11 is a cross-sectional view take substantially along line 11—11 of FIG. 7.
Figure 9:
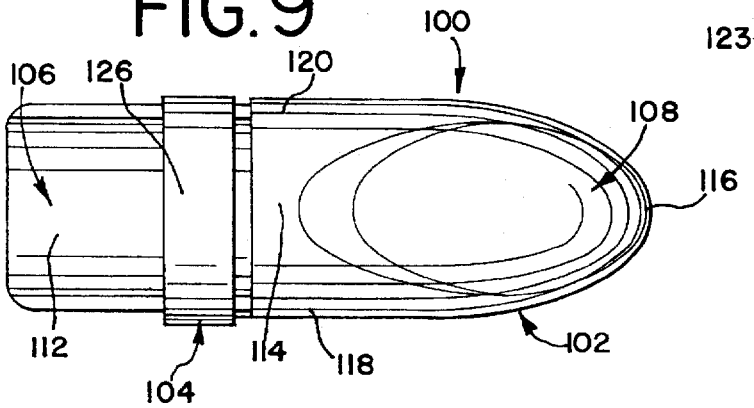
FIG. 9 is a top plan view of fingernail protector of FIG. 7 with the securing band in closed position.

The securing band 104 is pivotally connected at the end of the supporting base 106 opposite the ratchet teeth 130 by an integral hinge 123. The securing band 104 is semi-circular in shape and has inner and outer surfaces 124 and 126, respectively. The inner surface 124 is adapted to substantially mate with the top and sides of the finger 22 primarily above the first knuckle 24. A plurality of transversely extending ratchet teeth 128 are integrally formed on the inner surface 124 of the securing band 104 at the end opposite the integral hinge 123. The ratchet teeth 128 on the inner surface 124 of the securing band 104 are adapted to mate with the ratchet teeth 130 on the bottom or outer surface 110 of the supporting base 106 when the securing band is rotated around the finger from the open position, as shown in FIG. 8, to the closed position, as shown in FIGS. 7 and 9 to 11. This locks the supporting base on the finger and maintains the protective shield 102 on the finger 22 to protect the nail. The plurality of mating ratchet teeth 128 and 130 facilitate the adjustability of the fingernail protector 100 to fit different fingers on a hand as well as fingers of different sizes. After the nails are dry, the securing band is unlocked and the protective shield is removed from the finger. Although not shown, the securing band may include a release tab on its outer surface to facilitate disengaging the band. Further, the securing band may include a finger contact member like that in the embodiment of FIG. 6.

It should be appreciated that the one-piece fingernail protector could have a supporting base which engages the top and/or side of the finger and a securing band which engages the bottom and/or opposite side of the finger. Likewise, it should be appreciated that the two-piece fingernail protector could have a supporting base which engages the bottom and/or side of the finger and a securing band which engages the top and/or opposite side of the finger.

From the foregoing, it will be appreciated the improved fingernail protector of the present invention is adaptable for a range of finger sizes and fingernail lengths to prevent damage to wet or dry polish on a fingernail by being rigidly mounted on a finger such as to allow bending at the first knuckle.

It will be understood that modifications and variations may be effected without departing from the scope of the novel concepts of the present invention, but it is understood that this application is to be limited only by the scope of the appended claims.

The invention is hereby claimed as follows:

1. A device for protecting paint or polish on a nail of a finger while the paint or polish is drying after a manicure comprising:

a substantially rigid fingernail protective shield adapted to cover the nail; and means for adjustably and tightly locking said protective shield on said finger to rigidly mount the device on the finger and prevent the shield from contacting the nail during normal use, said locking means including mating ratchet teeth.

2. The device of claim 1, wherein said fingernail protective shield includes a supporting base adapted to engage said finger, and a hood extending from the supporting base to cover and protect the nail.

3. The device of claim 2, wherein said shield is sized and mounted on the finger such that the supporting base engages said finger ahead of the first knuckle and behind the nail.

4. The device of claim 2, wherein said hood includes substantially rigid back, top, forward, and side walls which define a fingernail cavity adapted to receive the nail.

5. The device of claim 2, wherein said locking means includes a band member hingedly connected to said supporting base, and said mating ratchet teeth being disposed on said band member and on the supporting base for releasably locking the band member to the supporting base.

6. The device of claim 1, wherein said locking means includes finger contact means for reducing the possibility of inhibiting finger circulation.

7. A device for protecting paint or polish on a nail of a finger while the paint or polish is drying after a manicure comprising:

a substantially rigid fingernail protective shield including a supporting base adapted to engage the finger and a hood extending from the supporting base to cover the nail;

means for adjustably and tightly locking said protective shield on said finger to rigidly mount the device on the finger and prevent the shield from contacting the nail during normal use, said locking means including a securing band having a first section adapted to mate with said supporting base and a second section hingedly connected to the first section to extend around and in engagement with the finger and to lockingly engage said first section to secure said protective shield on the finger.

8. The device of claim 7, wherein said locking means includes ratchet teeth on said first and second sections adapted to mate when said second section is rotated about the finger.

9. The device of claim 7, wherein said first and second sections are connected by an integral hinge.

10. The device of claim 9, wherein the first and second sections are extruded of a relatively rigid material, and said hinge is co-extruded of a relatively flexible material.

11. The device of claim 7, wherein said first section includes locking tabs for engaging the supporting base.

12. The device of claims 7, wherein said second section includes a release tab for disengaging the second section from the first section.

13. The device of claim 7, wherein said supporting base includes means for preventing the securing band from sliding off the supporting base.

14. The device of claim 7, wherein the second section is L-shaped and includes an arcuate portion engaging the finger and a locking portion having ratchet teeth adjustably engaging ratchet teeth on said first section.

15. The device of claim 14, wherein the arcuate portion includes a U-shaped finger contact member to reduce the possibility of inhibiting finger circulation.

16. The device of claim 7, wherein said locking means includes finger contact means for reducing the possibility of inhibiting finger circulation.

17. A two-piece fingernail protector for protecting a nail of a finger comprising:

a substantially rigid protective shield having a supporting base adapted to engage said finger substantially between the first knuckle and the nail, a hood extending from the base and adapted to shield and protect the nail; and an adjustable securing band engaging said base and finger to rigidly mount the shield on the finger, said band including a first section engaging the base, and a second section hingedly connected to the first section for engaging the finger, and coacting ratchet teeth means on said sections for releasably locking the sections together.

18. The fingernail protector of claim 17, wherein said supporting base and said first section are substantially semi-cylindrical.

19. The fingernail protector of claim 17, wherein said protective shield further includes means on said supporting base for preventing said securing band from slipping off said supporting base.

20. The fingernail protector of claim 17, wherein said protective shield is thermoformed from plastic and said securing band is extruded from plastic.

21. The fingernail protector of claim 17, wherein said second section of said securing bands includes an arcuately shaped finger-engaging portion.

22. The fingernail protector of claim 21, wherein said finger-engaging portion includes a finger contact member to reduce the possibility of inhibiting finger circulation.

23. A one-piece fingernail protector for protecting a nail of a finger comprising:

a substantially rigid protective shield having a supporting base and a hood extending from said supporting base, said supporting base adapted to engage said finger and said hood adapted to cover the nail; and adjustable securing means including a band member hinged to said supporting base and adapted to engage the finger, said band member and supporting base having ratchet teeth means adapted to coact and releasably lock the protective shield to the finger.

24. The fingernail protector of claim 23, wherein said supporting base and said bend member are substantially semi-cylindrical.

25. A two-piece fingernail protector for protecting a nail of a finger comprising:

a substantially rigid protective shield having a supporting base adapted to engage said finger, a hood extending from the base and adapted to shield and protect the nail; and a securing band engaging said base and finger to rigidly mount the shield on the finger, said band including a first section engaging the base, and a second section hingedly connected to the first section for engaging the finger, and means on said sections for releasably locking the sections together.

26. A two-piece fingernail protector for protecting a nail of a finger comprising:

a substantially rigid protective shield having a supporting base adapted to engage said finger, a hood extending from the base and adapted to shield and protect the nail; and a securing band engaging said base and finger to rigidly mount the shield on the finger, said band including a first section engaging the base, and a second section connected to the first section for engaging the finger, and coacting ratchet teeth on said sections adapted to releasably lock the sections together.

27. A fingernail protector for protecting a nail of a finger comprising:

a substantially rigid protective shield having a supporting base and a hood extending from said supporting base, said supporting base adapted to engage said finger and said hood adapted to cover the nail; and an adjustable securing band member coacting with said supporting base and adapted to engage the finger, said band member having ratchet teeth means adapted to releasably lock the protective shield to the finger.

28. A two-piece fingernail protector for protecting a nail of a finger comprising:

a substantially rigid protective shield having a supporting base adapted to engage said finger, a hood extending from the base and adapted to shield and protect the nail;

a securing band engaging said supporting base and finger to rigidly mount the shield on the finger, said band including a first section engaging the supporting base, and a second section connected to the first section for engaging the finger; and means on said supporting base for preventing said first section from slipping off said supporting base.

29. The fingernail protector of claim 28, wherein said preventing means includes a projecting lug extending from said supporting base.

30. A fingernail protector for protecting a nail of a finger comprising:

a substantially rigid protective shield including a supporting base adapted to engage the finger and a hood extending from the supporting base to cover the nail;

means coacting with the supporting base for tightly locking said protective shield on said finger to rigidly mount the protector on the finger and prevent the shield from contacting the nail during normal use, said locking means including a band member having a finger contact member which extends inwardly from the band member to engage the finger and space at least part of the band member from the finger to limit the contact between the band member and the finger thereby reducing the possibility of inhibiting circulation in the finger.

31. The finger protector of claim 30, wherein the finger contact area extends generally parallel to the long axis of the finger.

32. The finger protector of claim 30, wherein the finger contact area includes a smooth finger engaging surface.

33. The finger protector of claim 32, wherein said finger engaging surface is rounded.

* * * * *